US010867559B2

(12) United States Patent
Park et al.

(10) Patent No.: US 10,867,559 B2
(45) Date of Patent: Dec. 15, 2020

(54) DISPLAY DEVICE AND METHOD FOR DRIVING THE SAME

(71) Applicant: Samsung Display Co., Ltd., Yongin-si (KR)

(72) Inventors: Jun Hyun Park, Suwon-si (KR); Cheol-Gon Lee, Suwon-si (KR); Yang-Hwa Choi, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/296,098

(22) Filed: Mar. 7, 2019

(65) Prior Publication Data

US 2019/0287464 A1 Sep. 19, 2019

(30) Foreign Application Priority Data

Mar. 15, 2018 (KR) ..... 10-2018-0030287

(51) Int. Cl.
*G09G 3/3266* (2016.01)
*G09G 3/3225* (2016.01)
(Continued)

(52) U.S. Cl.
CPC ..... *G09G 3/3266* (2013.01); *G09G 3/3225* (2013.01); *G09G 3/3233* (2013.01);
(Continued)

(58) Field of Classification Search
CPC ..... G09G 2310/08; G09G 3/3266; G09G 2310/0205; G09G 3/3233;
(Continued)

(56) References Cited

U.S. PATENT DOCUMENTS 8,780,102 B2 7/2014 Han
9,293,082 B2 5/2016 Jeon
(Continued)

FOREIGN PATENT DOCUMENTS

KR 10-2011-0091293 8/2011
KR 10-2015-0144882 12/2015
(Continued)

OTHER PUBLICATIONS

Partial EP Search Report dated Aug. 1, 2019, issued in European Patent Application No. 19163082.1.
(Continued)

*Primary Examiner* — Sanjiv D. Patel
(74) *Attorney, Agent, or Firm* — H.C. Park & Associates, PLC

(57) ABSTRACT

A display device including: a scan driver that transmits scan signals to scan lines; a data driver that data signals to data lines; and a display portion that includes pixels, respectively connected to the corresponding scan lines and corresponding data lines, and displays an image by the pixels that simultaneously emit light according to the corresponding data signals, wherein each of pixels includes: an organic light emitting diode; a first transistor that includes a gate connected to a first node, and is connected between first power and an anode of the organic light emitting diode; a second transistor that includes a gate connected to a corresponding scan line and transmits the corresponding data signal to the first node; and a first capacitor that is connected to the first node, and stores a data voltage according to the data signal.

24 Claims, 10 Drawing Sheets

(51) Int. Cl.
*G09G 3/3275* (2016.01)
*G09G 3/3233* (2016.01)

(52) U.S. Cl.
CPC ... *G09G 3/3275* (2013.01); *G09G 2300/0809* (2013.01); *G09G 2300/0852* (2013.01); *G09G 2300/0866* (2013.01); *G09G 2310/0251* (2013.01); *G09G 2310/0262* (2013.01); *G09G 2310/063* (2013.01); *G09G 2320/0257* (2013.01); *G09G 2320/045* (2013.01)

(58) Field of Classification Search
CPC ..... G09G 2320/0233; G09G 2310/06; G09G 2310/02; G09G 2300/0819; G09G 2310/0283; G09G 3/3225; G09G 3/3258; H01L 27/3244
See application file for complete search history.

(56) References Cited

U.S. PATENT DOCUMENTS

| | | | | |
|---|---|---|---|---|
| 9,734,759 | B2 | 8/2017 | Kim et al. | |
| 9,911,384 | B2 | 3/2018 | Park | |
| 2012/0026145 | A1* | 2/2012 | Jeong | G09G 3/3233 345/211 |
| 2012/0235973 | A1* | 9/2012 | Yoo | G09G 3/3233 345/211 |
| 2014/0139505 | A1 | 5/2014 | Han | |
| 2015/0123557 | A1* | 5/2015 | Lee | G09G 3/3233 315/228 |
| 2015/0356921 | A1* | 12/2015 | Lee | G09G 3/3233 345/699 |
| 2017/0154578 | A1 | 6/2017 | In | |
| 2017/0186374 | A1 | 6/2017 | Kim | |
| 2017/0206836 | A1 | 7/2017 | Kim et al. | |
| 2017/0337872 | A1* | 11/2017 | Chai | G09G 3/3258 |
| 2019/0206316 | A1* | 7/2019 | Park | G09G 3/3275 |

FOREIGN PATENT DOCUMENTS

| | | |
|---|---|---|
| KR | 10-2016-0130066 | 11/2016 |
| KR | 10-2016-0148104 | 12/2016 |
| KR | 10-2017-0064583 | 6/2017 |

OTHER PUBLICATIONS

European Extended Search Report dated Dec. 16, 2019, issued in EP Patent Application No. 19163082.1.

* cited by examiner

DISPLAY DEVICE AND METHOD FOR DRIVING THE SAME

CROSS-REFERENCE TO RELATED APPLICATION

This application claims priority from and the benefit of Korean Patent Application No. 10-2018-0030287, filed on March 15, which is hereby incorporated by reference for all purposes as if fully set forth herein.

BACKGROUND

Field

Exemplary implementations of the invention relate generally to a display device and, more specifically, to a driving method thereof.

Discussion of the Background

A display device displays an image by using an organic light emitting diode (OLED) included in each pixel. Holes provided from an anode of the organic light emitting diode and electrons provided from a cathode of the organic light emitting diode combine in an emission layer such that the organic light emitting diode emits light.

Recently, responding to demand for a higher resolution display device, many more pixels have been disposed in a display area of the display device compared to a conventional display device. However, since it is difficult to very densely arrange pixels having a complex structure for compensation of a deviation in threshold voltage, pixels having a structure that can compensate for threshold voltage deviation while implementing a high resolution display device have been researched and developed.

In such pixels, the data voltage written into each of the pixels during a previous frame period may affect an image to be displayed during the next frame period, and accordingly, display quality of the display device may be deteriorated.

The above information disclosed in this Background section is only for understanding of the background of the inventive concepts, and, therefore, it may contain information that does not constitute prior art.

SUMMARY

Applicant discovered that in displays with very densely arranged pixels having a complex structure for compensation of a deviation in threshold voltage, the data voltage written into each of the pixels during a previous frame period may affect an image to be displayed during the next frame period, and accordingly, the display quality of the display device may deteriorate.

Devices constructed according to, and driving methods implementing, the principles and exemplary embodiments of the invention have been made in an effort to avoid the foregoing issues and to provide a display device in which display quality can be improved.

For example, devices constructed according to, and driving methods implementing, the principles and exemplary embodiments of the invention provide a display device that can initialize a second capacitor included in each of a plurality of pixels to eliminate a current leakage path and/or to prevent the leakage of a current flowing through the driving transistor during the data writing period by reducing level of the power supply to a value between low and high.

Additional features of the inventive concepts will be set forth in the description which follows, and in part will be apparent from the description, or may be learned by practice of the inventive concepts.

According to one or more exemplary embodiments, a display device includes: a scan driver configured to transmit a plurality of scan signals to a plurality of scan lines; a data driver configured to transmit a plurality of data signals to a plurality of data lines; and a display portion that includes a plurality of pixels, each of which is respectively connected to one of the corresponding scan lines and one of the corresponding data lines, and is configured to display an image through the plurality of pixels that simultaneously emit light according to the corresponding data signals, wherein each of the plurality of pixels includes: an organic light emitting diode; a first transistor that includes a gate connected to a first node, and being connected between a first power source and an anode of the organic light emitting diode; a second transistor that includes a gate connected to a corresponding scan line and being configured to transmit the corresponding data signal to the first node; and a first capacitor connected to the first node, and configured to store a data voltage based on the data signal, and wherein the scan driver is configured to simultaneously apply on-level scan signals to the plurality of scan lines at least two times during a period in which the gate of the first transistor is initialized.

The display device may further include a second capacitor that includes a first electrode connected to a corresponding data line and a second electrode connected with a first end of the second transistor at a second node.

The first capacitor may include a first electrode connected to an initialization power source and a second electrode connected to the first node.

The first power source may be configured to apply one of a first voltage level, a second voltage level that is higher than the first voltage level, and a third voltage level that is higher than the second voltage level, and the initialization power source may be configured to apply one of a fourth voltage level and a fifth voltage level that is higher than the fourth voltage level.

The first power source may apply the first voltage level for a period during which the gate of the first transistor is initialized and a period during which the plurality of data signals are transmitted to the plurality of data lines, and the first power source may apply the third voltage level for a period during which the organic light emitting diode emits light.

When the on-level scan signals are simultaneously applied to the plurality of scan lines for the period during which the gate of the first transistor is initialized, the initialization power source may apply the fifth voltage level, and when off-level scan signals are simultaneously applied to the plurality of scan lines, the initialization power source may apply the fourth voltage level.

The display device may further include a third transistor that includes a gate connected to the initialization power source, and being connected between the anode and the second node.

The display portion may further include a common control line that is connected to the plurality of pixels, the scan driver may be configured to transmit a common control signal to the common control line, and each of the plurality of pixels may include a third transistor that includes a gate connected to the common control line and being connected between the anode and the second node.

The scan driver may be configured to apply the on-level common control signal to the common control line during the period during in which the gate of the first transistor is initialized.

The display device may further include a light emission control driver configured to transmit a plurality of light emission control signals to a plurality of light emission control lines, wherein each of the plurality of pixels may be connected to a corresponding one of the light emission control lines, and the light emission control driver may be configured to simultaneously apply the on-level light emission control signals to the plurality of light emission control signal lines.

The display device may further include: a third transistor that includes a gate connected to the corresponding scan line, a first end connected to the first power source, and a second end connected to the first end of the first transistor at a second node; and a fourth transistor that includes a gate connected to the corresponding light emission control line, a first end connected to the first power source, and a second end connected to the second node, wherein the second transistor may include a first end connected to the first node and a second end connected to the anode, the first capacitor may include a first electrode connected to the first power and a second electrode connected to the first node, and the organic light emitting diode may further include a cathode connected to second power source.

The first power source may be configured to apply one of a first voltage level and a second voltage level that is higher than the first voltage level, and the second power source may be configured to apply one of a third voltage level, a fourth voltage level that is higher than the third voltage level, and a fifth voltage level that is higher than the fourth voltage level.

The first power source may be configured to apply the first voltage level and the second power source may be configured to apply the second voltage level during the period in which the gate of the first transistor is initialized, and the first power source may be configured to apply the second voltage level and the second power source may be configured to apply the third voltage level during a period in which the organic light emitting diode emits light.

For the period in which the gate of the first transistor is initialized, when the on-level scan signals are simultaneously applied to the plurality of scan lines, the light emission control driver may simultaneously apply the off-level light emission control signals to the plurality of light emission control signal lines, and when the off-level scan signals are simultaneously applied to the plurality of scan lines, the light emission control driver may be configured to simultaneously apply the on-level light emission control signals to the plurality of light emission control signal lines.

According to one or more exemplary embodiments, a method of driving a display device that includes a plurality of pixels and a scan driver to transmit a plurality of scan signals to a plurality of scan lines that are respectively connected to the plurality of pixels, wherein each of the plurality of pixels includes an organic light emitting diode, a first transistor that includes a gate connected to a first node and being connected between first power source and an anode of the organic light emitting diode, a second transistor that includes a gate connected to a corresponding scan line and being configured to transmit a data signal to a first node, and a first capacitor to store a data voltage based on the data signal includes the steps of: initializing the gate of the first transistor; compensating a threshold voltage of the first transistor; transmitting a data voltage based on the data signal to the first node; and generating a driving signal to cause light to be emitted from the organic light emitting diode, wherein in the step of initializing the gate of the first transistor, the scan driver simultaneously applies on-level scan signals to the plurality of scan lines at least two times.

Each of the plurality of pixels may further include a second capacitor that includes a first electrode connected to a data line to which the data signal is applied and a second electrode connected to a first end of the second transistor at a second node, the first capacitor may include a first electrode connected to an initialization power source and a second electrode connected to the first node, the first power source may be configured to apply a first voltage level, a second voltage level that is higher than the first voltage level, and a third voltage level that is higher than the second voltage level, and the initialization power source may be configured to apply one of a fourth voltage level, and a fifth voltage level that is higher than the fourth voltage level.

The step of initializing the gate of the first transistor may further include a step during which the first power source may apply the first voltage level, the initialization power source may apply the fifth voltage level when the on-level scan signals are simultaneously applied to the plurality of scan lines, and the initialization power source may apply the fourth voltage level when off-level scan signals are simultaneously applied to the plurality of scan lines.

The step of generating a driving signal to cause light to be emitted from the organic light emitting diode may further include a step in which the first power source applies the third voltage level.

The display device may further include a light emission control driver that transmits a plurality of light emission control signals to a plurality of light emission control lines, each of the plurality of pixels may be connected to a corresponding light emission control line, and the light emission control driver may simultaneously apply on-level light emission control signals to the plurality of light emission control signal lines.

The step of initializing the gate of the first transistor may further include: when the on-level scan signals are simultaneously applied to the plurality of scan lines, the light emission control driver may simultaneously apply off-level light emission control signals to the plurality of light emission control signal lines; and when the off-level scan signals are simultaneously applied to the plurality of scan lines, the light emission control driver may simultaneously apply on-level light emission control signals to the plurality of light emission control signal lines.

According to the exemplary embodiments, display quality of the display device can be improved.

Further, according to the exemplary embodiments, a display device having high-resolution can be implemented.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
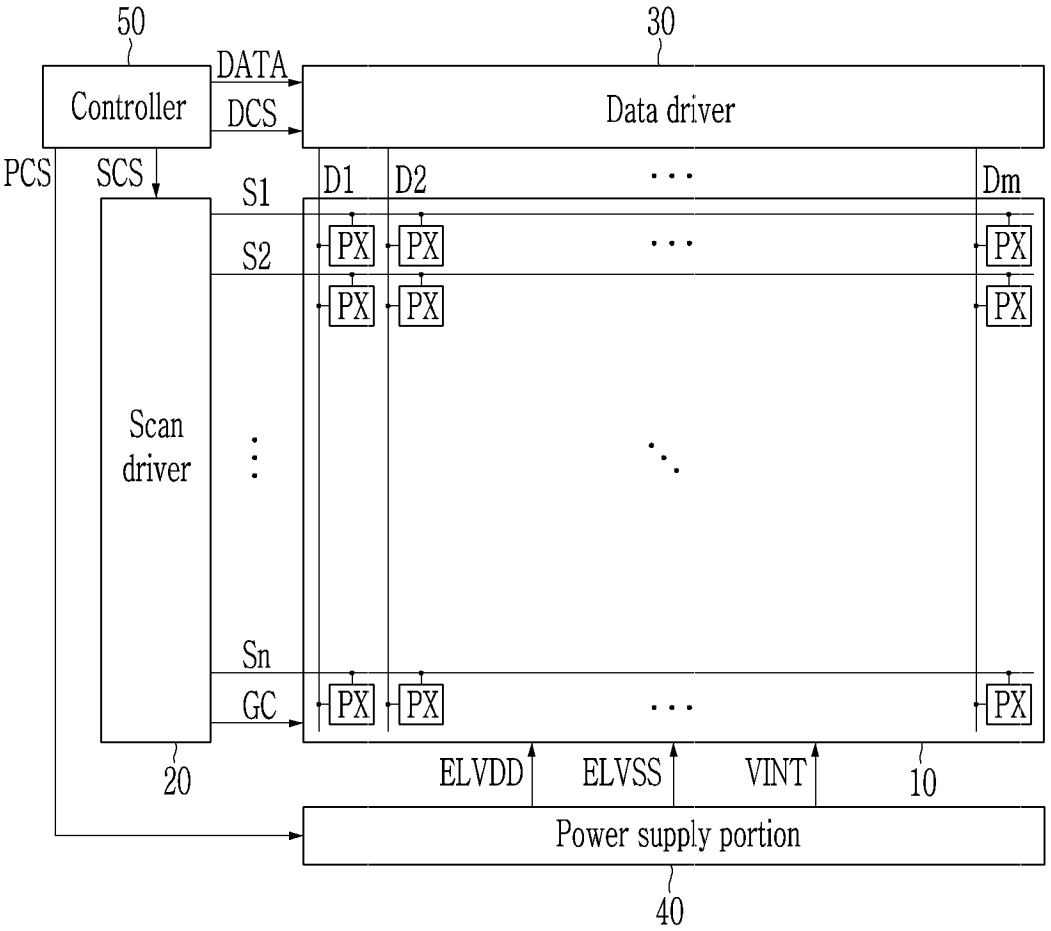
FIG. 1 is a block diagram of a display device constructed according to an exemplary embodiment of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of a display device constructed according to an exemplary embodiment of the invention. As shown in FIG. 1, a display device includes a display portion 10 that includes a plurality of pixels PX, a scan driver 20, a data driver 30, a power supply portion 40, and a controller 50.

The plurality of pixels PX included in the display portion are arranged substantially in a matrix format. Although it is not particularly limited, a plurality of scan lines S1 to Sn extend substantially in a row direction in the matrix format of the pixels and are substantially parallel with each other, and a plurality of data lines D1 to Dm substantially extend in a column direction and are substantially parallel with each other.

Each of the plurality of pixels PX is connected to a corresponding scan line along the plurality of scan lines S1 to Sn, a corresponding data line among the plurality of data lines D1 to Dm, and a common control line. The plurality of scan lines S1 to Sn, the plurality of data lines D1 to Dm, and the common control line are connected to the display portion 10. In addition, although it is not directly illustrated in the display portion 10 of FIG. 1, each of the plurality of pixels PX is connected with a power supply line that is connected to the display portion 10, and thus receives first power ELVDD, second power ELVSS, and initialization power VINT.

Each of the plurality of pixels PX emits light of a predetermined luminance by a driving current supplied to an organic light emitting diode of the pixel according to a data signal transmitted through the corresponding data line among the plurality of data lines D1 to Dm.

The scan driver 20 generates and transmits a scan signal corresponding to each pixel through each of the plurality of scan lines S1 to Sn. That is, the scan driver 20 transmits a scan signal through a corresponding scan line to each of a plurality of pixels included in each pixel row.

The scan driver 20 receives a scan driving control signal SCS from the controller 50 and generates a plurality of scan signals, and sequentially supplies the scan signals to the plurality of scan lines S1 to Sn that are connected to the respective pixel rows. In addition, the scan driver 20 generates a common control signal, and supplies a common control signal to the common control line connected to the plurality of pixels PX.

The data driver 30 transmits a data signal to each pixel through each of the plurality of data lines D1 to Dm.

The data driver 30 receives a data driving control signal DCS from the controller 50, and supplies a data signal corresponding to each of the plurality of data lines to each of the plurality of pixels PX included in each pixel row.

The power supply 40 supplies the first power ELVDD, the second power ELVSS, and the initialization voltage to each pixel of the display portion 10. A voltage value of each of the first power ELVDD, the second power ELVSS, and the initialization power VINT may fluctuate during one frame period.

In addition, the voltage value of each of the first power ELVDD, the second power ELVSS, and the initialization voltage VINT may be controlled by a power control signal PCS transmitted from the controller 50.

The controller 50 converts an image signal transmitted thereto from the outside into an image data signal DATA and transmits the image data signal to the data driver 30. The controller 50 receives an external control signal such as a vertical synchronization signal, a horizontal synchronization signal, a clock signal, a data enable signal, and the like, generates control signals to control driving of the scan driver 20, the data driver 30, and the power supply 40, and transmits the control signals to each of the scan driver 20, the data driver 30, and the power supply 40. That is, the controller 50 generates and transmits a scan driving control signal SCS that controls the scan driver 20, a data driving control signal DCS that controls the data driver 30, and a power control signal PCS that controls the power supply 40.

Next, referring to FIG. 2 to FIG. 4, an example of a pixel included in the display device of FIG. 1 will be described.

Figure 2:
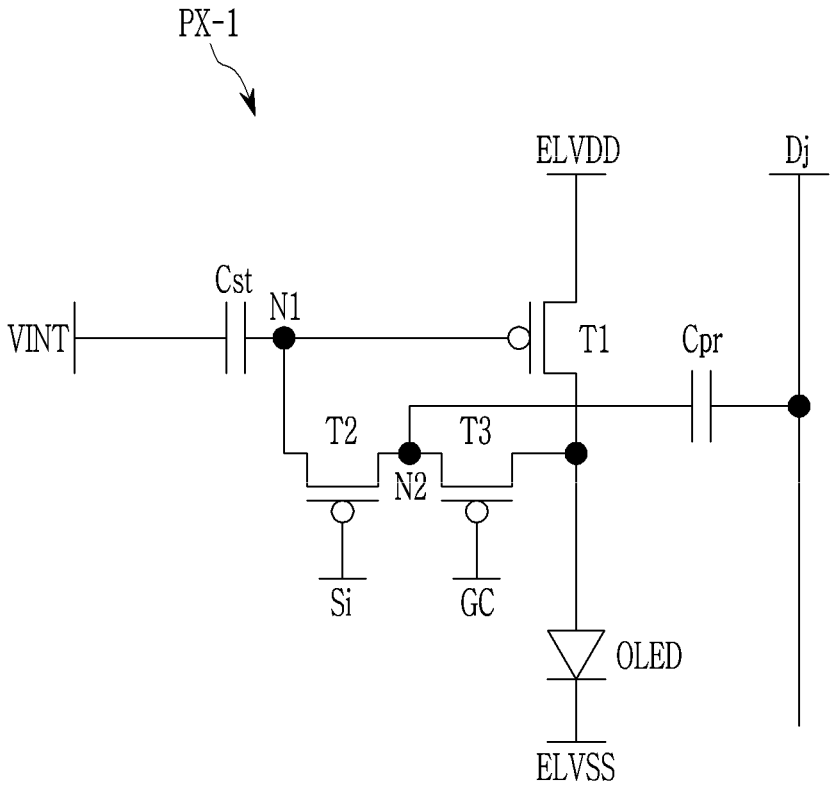
FIG. 2 is a circuit diagram of an example of a pixel included in the display device of FIG. 1.

FIG. 2 is a circuit diagram illustrating an example of a pixel included in the display device of FIG. 1. As shown in FIG. 2, a pixel PX-1 may include an organic light emitting diode OLED, a first transistor T1, a second transistor T2, a third transistor T3, a first capacitor Cst, and a second capacitor Cpr. The pixel PX-1 is representative and may be disposed at an i-th pixel row and a j-th pixel column.

The first transistor T1 may be a driving transistor. In the exemplary embodiment, the first transistor T1 may include a gate connected to a first node N1, a first end connected to the first power ELVDD, and a second end connected to an anode of the organic light emitting diode OLED.

The driving current is a current that corresponds to the voltage difference between the gate and the first end of the first transistor T1, and the driving current is changed corresponding to a data voltage based upon an applied data signal D[j].

The second transistor T2 may connect the first node N1 and a second node N2 according to a level of an i-th scan signal S[i]. In the exemplary embodiment, the second transistor T2 may include a gate connected to an i-th scan line Si, a first end connected to the first node N1, and a second end connected to the second node N2.

The third transistor T3 may connect the second node N2 and the anode of the organic light emitting diode OLED corresponding to a common control signal GC. In the exemplary embodiment, the third transistor T3 may include a gate connected to the common control signal line GC, a first end connected to the second node N2, and a second end connected to the anode of the organic light emitting diode OLED.

The first capacitor Cst is connected between the initialization power VINT and the first node N1. In the exemplary embodiment, the first capacitor Cst may include a first end connected to the initialization power VINT and a second end connected to the first node N1.

The second capacitor Cpr is connected between a j-th data line and the second node N2. In the exemplary embodiment, the second capacitor Cpr may include a first end connected to the j-th data line and a second end connected to the second node N2.

The organic light emitting diode OLED may emit light as the driving current flows from the first transistor T1. In the exemplary embodiment, the organic light emitting diode OLED may include an anode connected to the second end of the first transistor T1 and a cathode connected to the second power ELVSS.

Next, a driving method of a display device that includes the pixel of FIG. 2 will be described with reference to FIG. 3 and FIG. 4.

Figure 3:
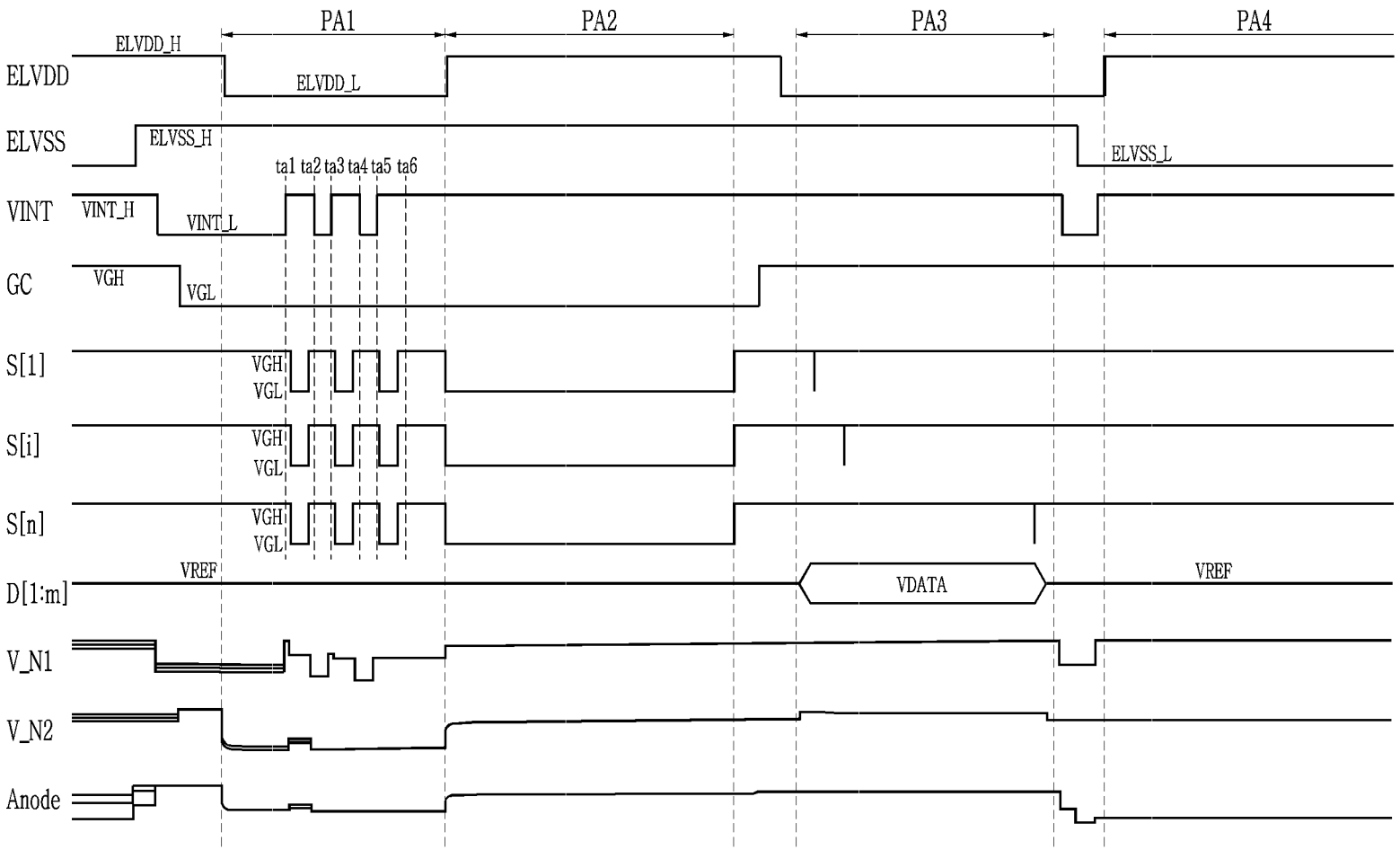
FIG. 3 and FIG. 4 are timing diagrams illustrating an exemplary driving method of a display device including the pixel of FIG. 2.
Figure 4:
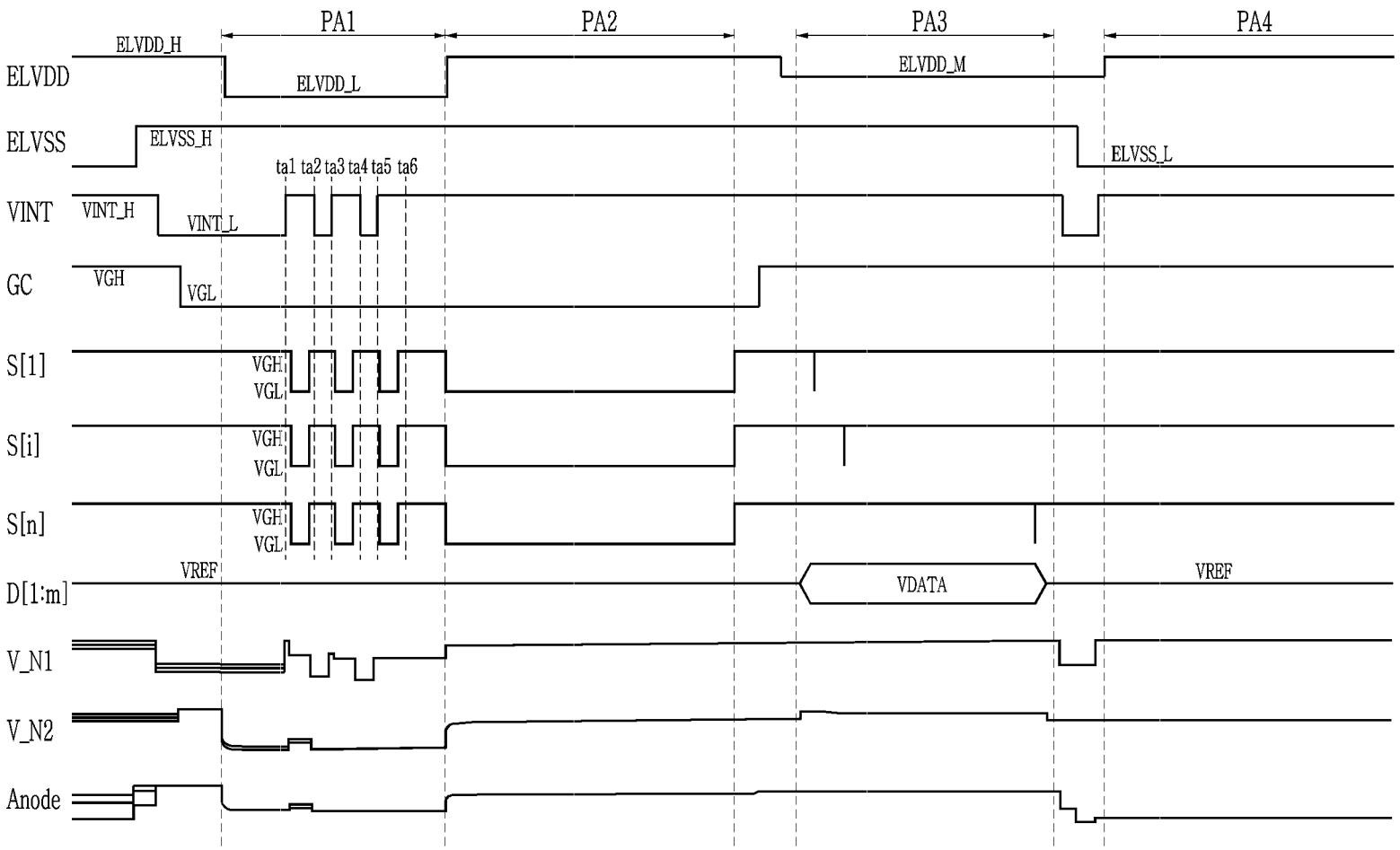

FIG. 3 and FIG. 4 are timing diagrams of an exemplary driving method of a display device including the pixel of FIG. 2. As shown in FIG. 3 and FIG. 4, the display device may operate by a simultaneous light emission method that includes non-light emission periods PA1 to PA3 during which pixels PX do not emit light and a light emission period PA4 during which the pixels PX simultaneously emit light.

The non-light emission period may include an initialization period PA1 during which the gate of the first transistor T1 and the anode of the organic light emitting diode OLED are initialized, a threshold voltage compensation period PA2 during which the first transistor T1 is diode-connected, and a data writing period PA3 during which data signals are written in the pixels PX.

The pixels PX may be connected to the first power ELVDD, the second power ELVSS, and the initialization power VINT, with each having a fluctuating voltage level within one frame period. For example, the first power ELVDD may have one of a first voltage level ELVDD_L, a second voltage level ELVDD_M that is higher than the first voltage level ELVDD_L, and a third voltage level ELVDD_H that is higher than the second voltage level ELVDD_M. The initialization voltage VINT may have one of a fourth voltage level VINT_L, and a fifth voltage level VINT_H that is higher than the fourth voltage level VINT_L. The second power ELVSS may have one of a sixth voltage level ELVSS_L, and a seventh voltage level ELVSS_H that is higher than the sixth voltage level ELVSS_L.

The common control signal GC has a gate on voltage level VGL during the initialization period PA1 and the threshold voltage compensation period PA2, and a gate off voltage level VGH during the data writing period PA3 and the light emission period PA4. In addition, a reference voltage VREF may be applied to a data line during a period other than the data writing period PA4, and a data signal may be supplied to a data line for expression of grays during the data writing period PA4.

As shown in FIG. 3, in the initialization period PA1, the first power ELVDD has the first voltage level ELVDD_L, the second power ELVSS has the seventh voltage level ELVSS_H, and the common control signal GC has the gate on voltage level VGL. The third transistor is turned on by the common control signal GC of the gate on voltage level VGL, and thus the anode and the second node N2 are connected.

The initialization power VINT has the fourth voltage level VINT_L before a time ta1 within the initialization period PA1. The second node N2 and the anode are connected to the first power ELVDD through the first transistor T1 turned on by the initialization power VINT, and thus the second node and the anode are initialized with a voltage acquired by applying a threshold voltage Vth of the first transistor T1 to the first voltage level ELVDD_L. At the start time of the initialization period PA1, the voltage V_N2 of the second node and the voltage of the anode of the organic light emitting diode OLED are initialized to a voltage (ELVDD_L+Vth) when the first power ELVDD is changed to the first voltage level ELVDD_L. That is, the voltage of the anode of the organic light emitting diode OLED can be initialized.

During a period ta1 to ta2, the initialization power VINT has a fifth voltage level VINT_H, and the scan signals S[1] to S[n] have the gate-on voltage level VGL. The first transistor T1 is turned off by the initialization power VINT. In addition, the second transistor T2 of each of the pixels PX is turned on by the scan signals S[1] to S[n] of the gate-on voltage level VGL, and thus the first node N1 and the second node N2 are connected.

That is, since the first node N1, the second node N2, and the anode are all connected during the period ta1 to ta2 after the second node N2 and the anode are initialized to the first power ELVDD of the first voltage level ELVDD_L, the voltage of the first capacitor Cst, which remains even after a light emission period of the previous frame period, is initialized.

During a period ta2 to ta3, the initialization power VINT has a fourth voltage level VINT_L, and the scan signals S[1] to S[n] have the gate-off voltage level VGH. The second node N2 and the anode are connected back to the first power ELVDD through the first transistor T1, which has been turned on by the initialization power VINT, and thus the second node N2 and the anode are initialized to a voltage (ELVDD_L+Vth).

Next, during a period ta3 to ta4, the initialization power VINT has the fifth voltage level VINT_H again, and the scan signals S[1] to S[n] again have the gate-on voltage level VGL.

Thus, the first node N1, the second node N2, and the anode are all connected during the period ta3 to ta4 after the second node N2 and the anode are initialized back to the first voltage level ELVDD_L, and accordingly, the voltage of the first capacitor Cst, remaining even after the period ta2 to ta3, is initialized again.

During a period ta5 to tab, the scan signals S[1] to S[n] have the gate-on voltage level VGL, and then may have the gate-off voltage level VGH until before the threshold voltage compensation period PA2.

In addition, during the period ta5 to tab, the scan signals S[1] to S[n] have the gate-on voltage level VGL, and then may maintain the gate-on voltage level VGL until the threshold voltage compensation period PA2.

The data voltages according to the data signals, which have been written during the previous frame period, remain in the first nodes N1 of the respective pixels PX even after light emission is terminated. According to the illustrated embodiment, a first operation that connects all of the first node N1, the second node N2, and the anode and a second operation that initializes the second node N2 and the anode to the first power ELVDD of the first voltage level ELVDD_L may be iteratively performed to initialize the first node N1. In the timing diagram of FIG. 3, the first operation is performed three times and the second operation is performed three times, but the first node N1 may be initialized only by sequentially performing the first operation, the second operation, and the first operation. Alternatively, the first node N1 may be initialized by alternately iteratively performing the first operation and the second operation during the initialization period PA1.

In the threshold voltage compensation period PA2, the first power ELVDD has a third voltage level ELVDD_H, the initialization power VINT has a fifth voltage level VINT_H, and the second power ELVDD has a seventh voltage level ELVSS_H. The scan signals S[1] to S[n] may have the gate-on voltage level VGL. Accordingly, the gate of the first transistor T1 and the second end of the first transistor T1 are connected by the turned-on second transistor T2 and the turned-on third transistor T3, and accordingly, the first transistor T1 can be diode-connected.

Here, in the threshold voltage compensation periods PA2 in the exemplary embodiments of FIG. 3 and FIG. 4, the first power ELVDD may have a voltage level between the third voltage level ELVDD_H and the first voltage level ELVDD_L, which may be the same as or different from the second voltage level ELVDD_M. The voltage V_n1 of the first node n1 and the voltage V_N2 of the second node N2 may correspond to a voltage that is acquired by applying a threshold voltage of the first transistor T1 to the first voltage level ELVDD_H, which is ELVDD_H+Vth.

In the data writing period PA3, the first power ELVDD has the first voltage level ELVDD_L, the initialization power VINT has the fifth voltage level VINT_H, and the scan driver 20 may sequentially provide the scan signals S[1] to S[n] which have the gate-on voltage level VGL for writing of a data signal D[j] into the pixels.

Since the first node N1 and the second node N2 are connected by the turned-on second transistor T2, the voltage of the data signal D[j], applied to the data line Dj is divided between the first capacitor Cst and the second capacitor Cpr, and a corresponding data voltage is stored in the first capacitor Cst.

In a pixel PX-1, while the data voltage according to the data signal D[j] is applied to the gate (i.e., the first node N1) of the first transistor T1, the second node N2 and the anode may be electrically separated by the third transistor T3, which is in the turned-off state. Accordingly, when a current leakage flowing to the anode from the first power ELVDD occurs through the first transistor T1, the data voltage applied to the second node N2 and the gate of the first transistor T1 by the third transistor T3 in the turned-off state is not affected so that display quality can be improved.

In the light emission period PA4, the first power ELVDD has the third voltage level ELVDD_H, the initialization power VINT has the fifth voltage level VINT_H, and the second power ELVSS has the sixth voltage level ELVSS_L. The scan signal S[i] may have the gate-off voltage level VGH. That is, in the light emission period PA4, the initialization power VINT increased to the fifth voltage level VINT_H from the fourth voltage level VINT_L, and the voltage V_N1 (i.e., a voltage of the gate of the driving transistor) of the first node N1 may be increased corresponding to the variation amount (i.e., VINT_H-VINT_L) of the initialization power VINT. Accordingly, a driving current based on a voltage difference between the gate and the first end of the first transistor T1 is generated and flows to the organic light emitting diode OLED through the first transistor T1, and thus pixels can simultaneously emit light.

Although it is exemplarily illustrated in FIG. 3 that the pixels are driven by the first power ELVDD, the initialization power VINT, and the second power ELVSS, which fluctuate within one frame period, the pixels may be driven by various methods. For example, as shown in FIG. 4, in the data writing period PA3, the first power ELVDD has the second voltage level ELVDD_M, the initialization power VINT has the fifth voltage level VINT_H, and the second driver 20 may sequentially provide the scan signals S[1] to S[n] having the gate-on voltage level VGL to the scan lines for writing data signals into the pixels. That is, unlike the pixel driving method shown in FIG. 3, the pixel driving method shown in FIG. 4 can prevent the leakage of a current flowing to the anode from the first power ELVDD through the first transistor T1 during the data writing period PA3 by changing the first power ELVDD to the second voltage level ELVDD_M. That is, a current leakage path can be removed by setting a voltage of the first end of the first transistor T1 to a voltage (e.g., the second voltage level ELVDD_M) between the first voltage level ELVDD_L and the third voltage level ELVDD_H. Accordingly, a change of the data signal written into the pixel due to the current leakage can be prevented, and display quality deterioration (e.g., viewing of a stain) due to luminance deviation between the pixels can be prevented.

In the illustrated embodiment, the second transistor T2 may be a low-temperature polysilicon (LTPS) thin film transistor and the third transistor T3 may be an oxide thin film transistor. The low-temperature polysilicon thin film transistor has relatively excellent electron mobility and stability, but has a relatively high possibility of occurrence of leakage current. Accordingly, the third transistor T3 is provided as an oxide thin film transistor to thereby effectively prevent a current leakage flowing through the third transistor T3.

Next, an example of a pixel that may be included in the display device of FIG. 1 will be described with reference to FIG. 5 to FIG. 7.

Figure 5:
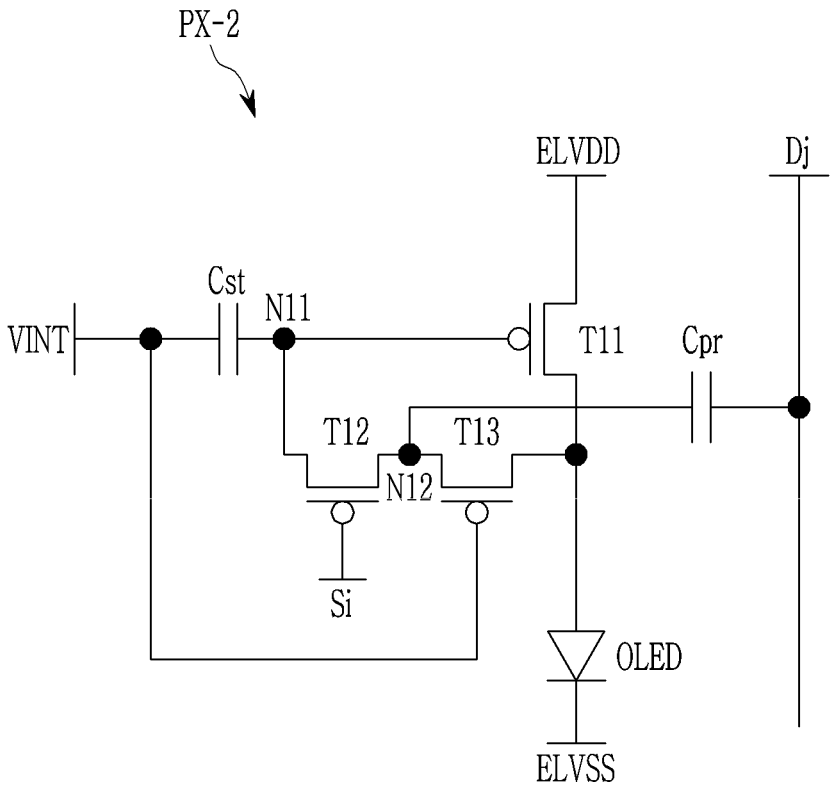
FIG. 5 is a circuit diagram of another example of a pixel included in the display device of FIG. 1.

FIG. 5 is a circuit diagram of another example of a pixel included in the display device of FIG. 1. Referring to FIG. 5, a pixel PX-2 may include an organic light emitting diode OLED, a first transistor T11, a second transistor T12, a third transistor T13, a first capacitor Cst, and a second capacitor Cpr. The pixel PX-2 may be disposed in an i-th pixel row and a j-th pixel column. However, the pixel PX-2 according to the illustrated exemplary embodiment is substantially the same as the pixel of FIG. 2, except that a gate of a third transistor T3 is connected to initialization power VINT, and therefore the same reference numerals are used for the same or similar components, and a redundant description will be omitted.

The first transistor T11 may include a gate connected to a first node N11, a first end connected to first power ELVDD, and a second end connected to an anode of the organic light emitting diode OLED. The second transistor T12 may include a gate connected to an i-th scan line Si, a first end connected to the first node N11, and a second end connected to the second node N12. The third transistor T3 may include the gate connected to the initialization VINT, a first end connected to the second node N12, and a second end connected to the anode of the organic light emitting diode OLED.

The first capacitor Cst is connected between the initialization power VINT and the first node N11. The second capacitor Cpr is connected between a j-th data line and the second node N12. The organic light emitting diode OLED may emit light as driving current flows from the first transistor T1.

Figure 6:
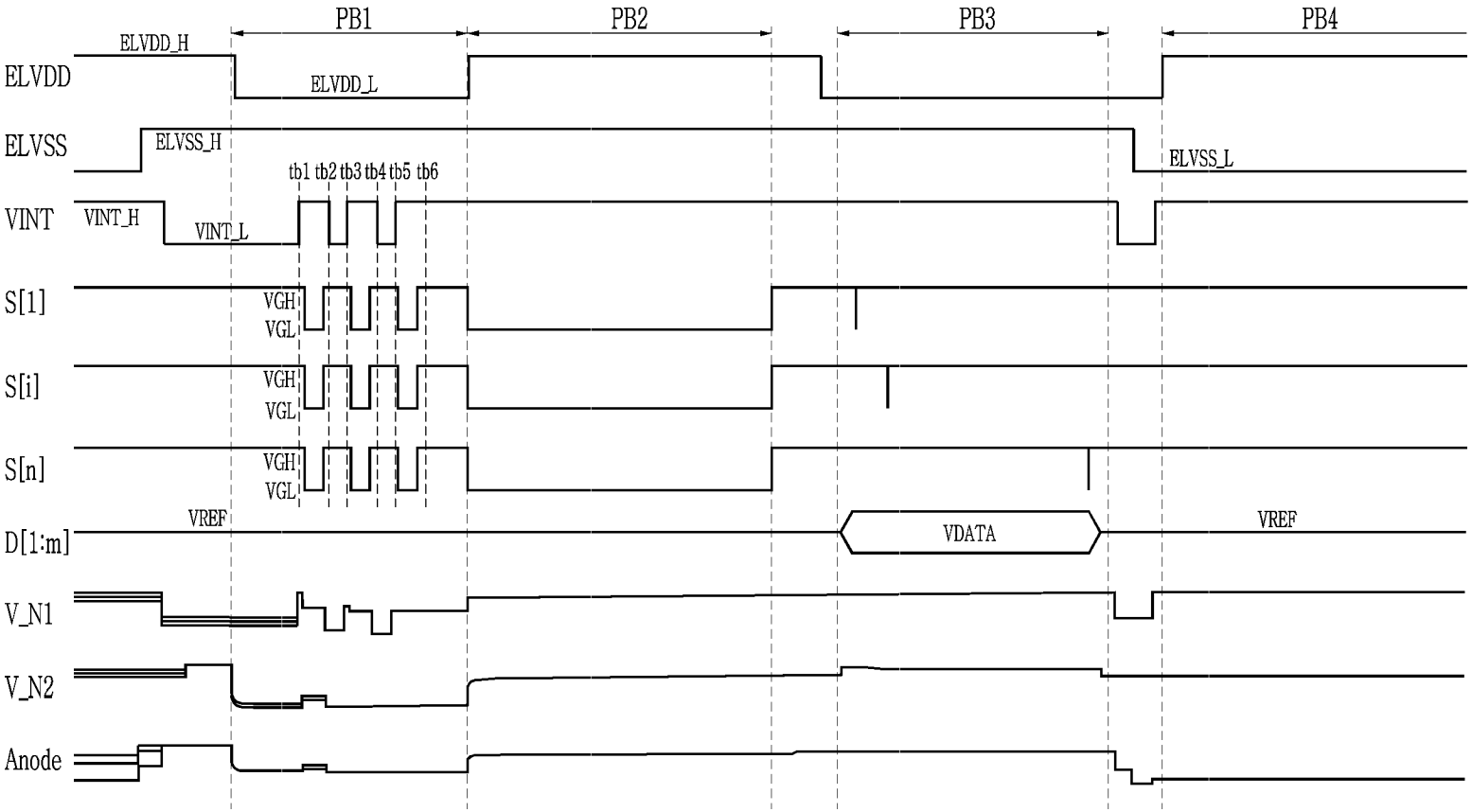
FIG. 6 and FIG. 7 are timing diagrams illustrating an exemplary driving method of a display device including the pixel of FIG. 5.
Figure 7:
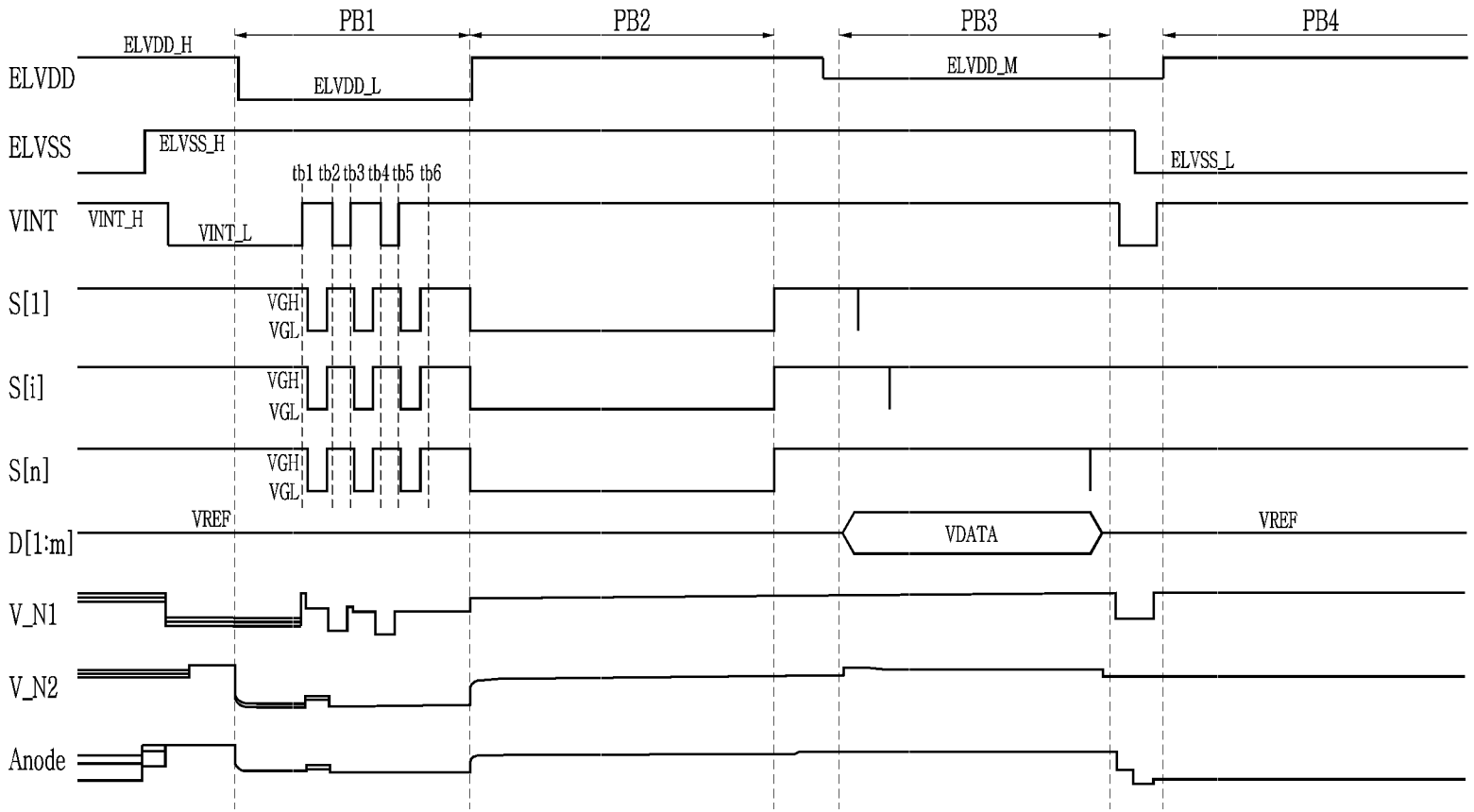

FIG. 6 and FIG. 7 are timing diagrams of an exemplary pixel driving method of a display device including the pixel of FIG. 5.

As shown in FIG. 6 and FIG. 7, the pixel PX-2 shown in FIG. 5 may be driven by substantially the same method as the driving method of the pixel PX-1, shown in FIG. 3, but rather than a common control signal line GC, initialization power VINT is connected to the third transistor T13.

Before a time tb1 within an initialization period PB1, the initialization power VINT has a fourth voltage level VINT_L. Then, the second node N12 and the anode are connected to the first power ELVDD such that they are initialized with a voltage that is acquired by applying a threshold voltage of the first transistor T1 to the first voltage level ELVDD_L.

During a period tb1 to tb2 within the initialization period PB1, the initialization power VINT has a fifth voltage level VINT_H, and scan signals S[1] to S[n] have a gate-on voltage level VGL. Then, second transistors T12 of the pixels PX are turned on, and thus the first node N11 and the second node N12 are connected.

That is, the second node N12 and the anode are initialized to the first power ELVDD of the first voltage level ELVDD_L and then the first node N11 and the second node N12 are connected with each other during the period tb1 to tb2, and therefore a voltage of the first capacitor Cst remaining even after a light emission period of a previous frame period, is initialized.

During a period tb2 to tb3, the initialization power VINT has the fourth voltage level VINT_L, and the scan signals S[1] to S[n] have the gate-off voltage level VGH. The second node N12 and the first node N11 are connected back to the first power ELVDD through the first transistor T11, which has been turned on by the initialization power VINT, and thus the second node N12 and the anode are initialized to a voltage acquired by applying the threshold voltage of the first transistor T11 to the first voltage level ELVDD_L.

Next, during a period tb3 to tb4, the initialization power VINT again has the fifth voltage level VINT_H, and the scan signals S[1] to S[n] again have the gate-on voltage level VGL. Then, after the second anode N12 and the anode are initialized back to the first voltage level LEVDD_L, the first node N11 and the second node N12 are connected during a period tb3 to tb4, and thus a voltage of the first capacitor Cst, remaining even after the period tb2 to tb3, is initialized again.

During a period tb5 to tb6, the scan signals S[1] to S[n] have the gate-on voltage VGL, and may have the gate-off voltage level VGH until before the threshold voltage compensation period PB2.

In addition, during the period tb5 to tb6, the scan signals S[1] to S[n] may have the gate-off voltage level VGH, and then may maintain the gate-off voltage level VGH until the threshold voltage compensation period PB2.

A data voltage according to a data signal written during a previous frame period remains in the first node N11 of each pixel even after light emission is terminated. According to the illustrated embodiment, for initialization of the first node N11, a first operation that connects the first node N11 and the second node N12 and a second operation that initializes the second node N12 and the anode to the first power ELVDD of the first voltage level ELVDD_L may be iteratively performed. In the timing diagram of FIG. 6, the first operation is performed three times and the second operation is performed three times, but the first node N11 may be initialized only by sequentially performing the first operation, the second operation, and the first operation. Alternatively, the first node N11 may be initialized by alternately iteratively performing the first operation and the second operation during the initialization period PB1.

During the threshold voltage compensation period PB2, the first power ELVDD has a third voltage level ELVDD_H, the initialization power VINT has a fifth voltage level VINT_H, and the second power ELVSS has a seventh voltage level ELVSS_H. Accordingly, the gate of the first transistor T11 and the second end of the first transistor T11 are connected by the turned-on second transistor T12 and the turned-on third transistor T13, and thus the first transistor T11 may be diode-connected.

Here, in the threshold voltage compensation period PB2 of the exemplary embodiments of FIG. 6 and FIG. 7, the first power ELVDD may have a voltage level between the third voltage level ELVDD_H and the first voltage level ELVDD_L, and the voltage may be equal to or different from the second voltage level ELVDD_M.

A voltage V_N1 of the first node N11 and a voltage V_N2 of the second node N12 may correspond to a voltage that is acquired by applying the threshold voltage of the first transistor T11 to the first voltage level ELVDD_H.

Regarding to the data writing period PB3 and the light emission period PB4, pixels may be driven by a method that is substantially the same as the driving method of the pixels shown in FIG. 3, and therefore a redundant description will be omitted.

In addition, unlike the pixel driving method shown in FIG. 6, in the pixel driving method shown in FIG. 7, the first power ELVDD is changed to the second voltage level ELVDD_M during the data writing period PB3, and thus a leakage of a current flowing to the anode from the first power ELVDD through the first transistor T11 during the data writing period PB3 can be prevented. That is, a voltage of the first end of the first transistor T11 is set to a voltage (e.g., the second voltage level LEVDD_M) between the first voltage level ELVDD_L and the third voltage level ELVDD_H to thereby remove a current leakage path. Accordingly, variation of a data signal written into the pixel due to the current leakage can be prevented, and display quality deterioration (e.g., visibility of a stain) due to luminance deviation between pixels can be prevented.

Next, a display device according to another exemplary embodiment will be described with reference to FIG. 8 to FIG. 10.

Figure 8:
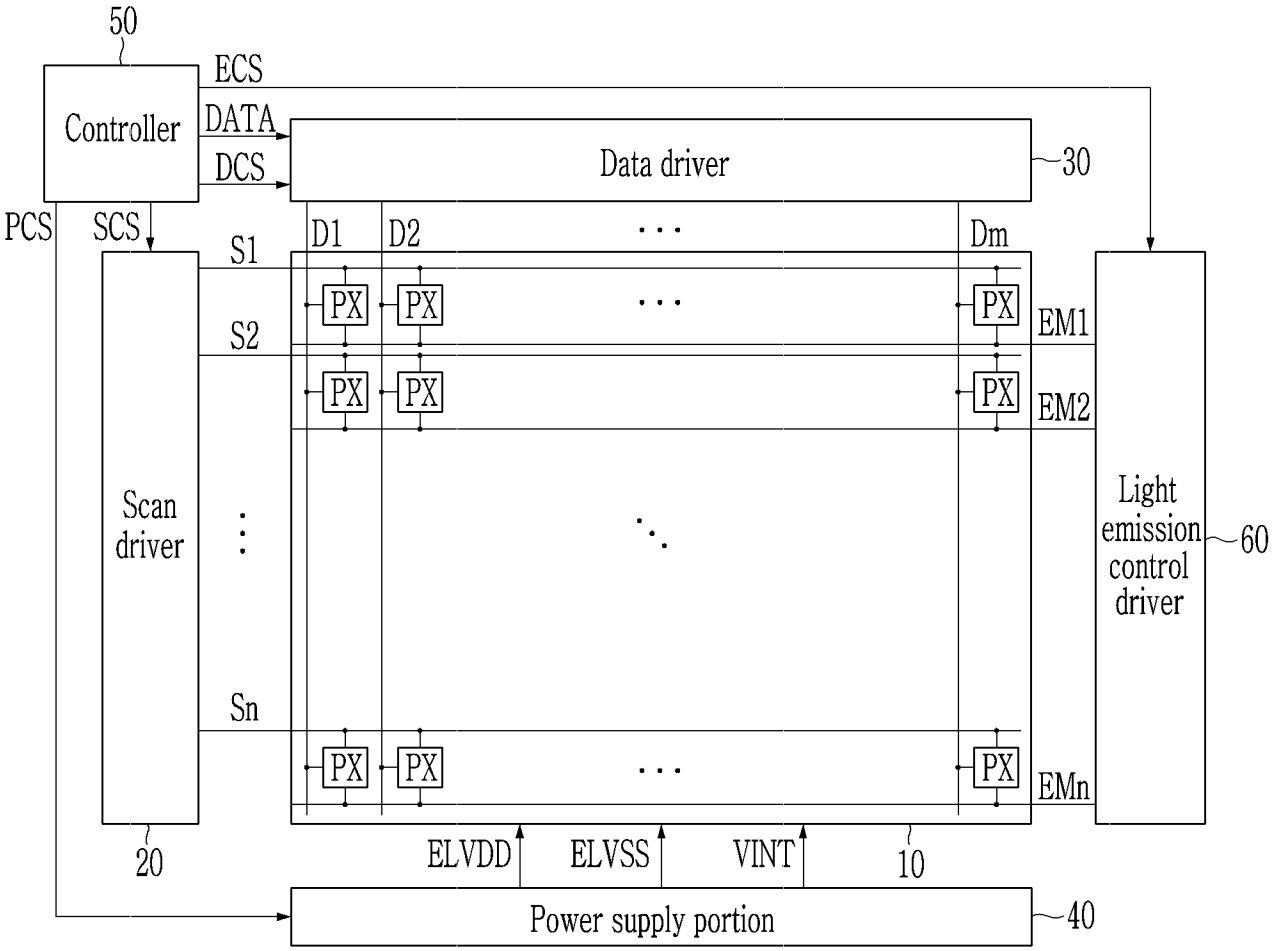
FIG. 8 is a block diagram of a display device constructed according to another exemplary embodiment of the invention.

FIG. 8 is a block diagram of a display device constructed according to another exemplary embodiment of the invention. FIG. 8 is not significantly different from the display device of FIG. 1, and therefore the additional elements not shown in FIG. 1 will be mainly described to avoid redundancy.

In particular, unlike the display device of FIG. 2, the display device of FIG. 8 further includes a light emission control driver 60 in addition to a display portion 10 that includes a plurality of pixels PX, a scan driver 20, a data driver 30, a power supply 40, and a controller 50.

The light emission control driver 60 is connected to a plurality of light emission control lines EM1 to EMn that are connected to the plurality of pixels PX. That is, the plurality of light emission control lines EM1 to EMn that extend substantially parallel to each other while opposing the plurality of pixels PX in an approximately row direction connect the plurality of pixels PX and the light emission control driver 60.

The light emission control driver 60 generates a light emission control signal that corresponds to each pixel, and transmits the generated light emission control signal to the corresponding pixel through the plurality of light emission control lines EM1 to EMn. Each pixel PX which has received the light emission control signal is controlled to emit light according to a level of the light emission control signal. That is, an operation of a light emission control transistor included in each pixel PX is controlled in response to the light emission control signal transmitted through a corresponding light emission control line, and accordingly, an organic light emitting diode OLED connected with the light emission control transistor may or may not emit light with luminance according to a driving current that corresponds to a data signal.

The controller 50 of FIG. 8 transmits a light emission driving control signal ECS that controls operation of a light emission control driver to the light emission control driver 60. The light emission control driver 60 receives the light emission driving control signal ECS from the controller 50 and generates the plurality of light emission control signals.

Figure 9:
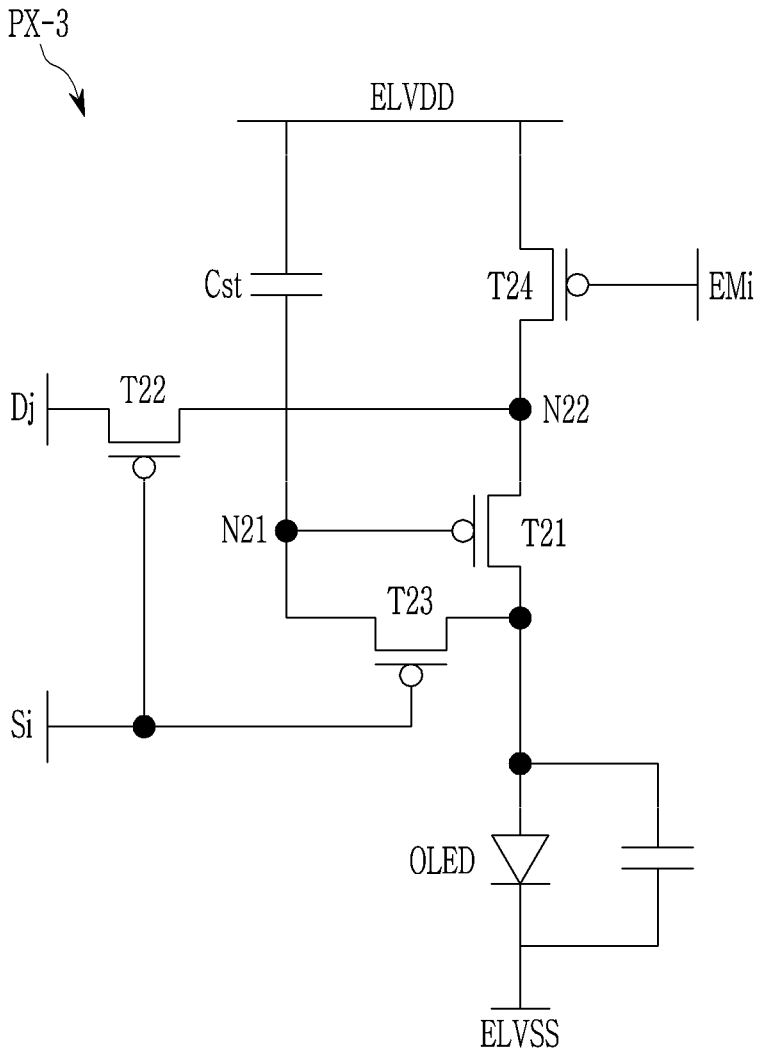
FIG. 9 is a circuit diagram of an example of a pixel included in the display device of FIG. 8.

FIG. 9 is a circuit diagram of an example of a pixel included in the display device of FIG. 8.

A pixel PX-3 shown in FIG. 8 includes an organic light emitting diode OLED, a first capacitor Cst, and first to fourth transistors T21, T22, T23, and T24.

The first transistor T21 may include a gate connected to a first node N21, a first end connected to a second node N22, and a second end connected to an anode of the organic light emitting diode OLED. A driving current flows through the first transistor T21 according to a corresponding data signal D[i].

The driving current is a current that corresponds to the voltage difference between the gate and the first end of the transistor T21, and the driving current is changed corresponding to a data voltage based on an applied data signal D[j].

The second transistor T22 includes a gate connected to a i-th scan line Si, a first end connected to a j-th data line Dj, and a second end connected to the second node N22. The second transistor T22 transmits a data voltage according to the data signal D[j], which has been transmitted through an j-th data line Dj in response to a corresponding scan signal S[i], which has been transmitted through a i-th scan line Si.

The third transistor T23 includes a gate connected to the i-th scan line Si, and opposite ends that are respectively connected to the gate and the second end of the first transistor T21. The third transistor T23 operates in response to a corresponding scan signal S[i] transmitted through the i-th scan line Si. A turned-on third transistor T23 connects the gate and the second end of the first transistor T21 such that the first transistor T21 is diode-connected.

When the first transistor T21 is diode-connected, a voltage acquired by compensating a data voltage applied to the first end of the first transistor T21 by as much as the threshold voltage of the first transistor T21 is applied to the gate of the first transistor T21. Since the gate of the first transistor T21 is connected to the first end of the first capacitor Cst, the voltage is maintained by the first capacitor Cst. The gate of the first transistor T21 maintains the voltage to which the threshold voltage of the first transistor T21 is applied, and therefore, a driving current flowing to the first transistor T21 is not affected by the influence of the threshold voltage of the first transistor T21.

The fourth transistor T24 may include a gate connected to a i-th light emission control line EMi, a first end connected to the first power ELVDD, and a second end connected to the second node N22.

The fourth transistor T24 operates in response to a i-th light emission control signal EM[i] transmitted through the i-th light emission control line EMi. When the fourth transistor T24 is turned on in response to the i-th light emission control signal EM[i], a current path is formed in a direction toward the organic light emitting diode OLED from the first power ELVDD such that the driving current may flow therethrough. Then, the organic light emitting diode OLED emits light according to the driving current, and an image of a data signal is displayed.

The first capacitor Cst includes a first end connected to the first node N21 and a second end connected to the first power ELVDD. Since the first capacitor Cst is connected between the gate of the first transistor T21 and the first power ELVDD as previously described, a voltage applied to the gate of the first transistor T21 can be maintained.

Next, a driving method of the display device of FIG. 8 will be described with reference to FIG. 10.

Figure 10:
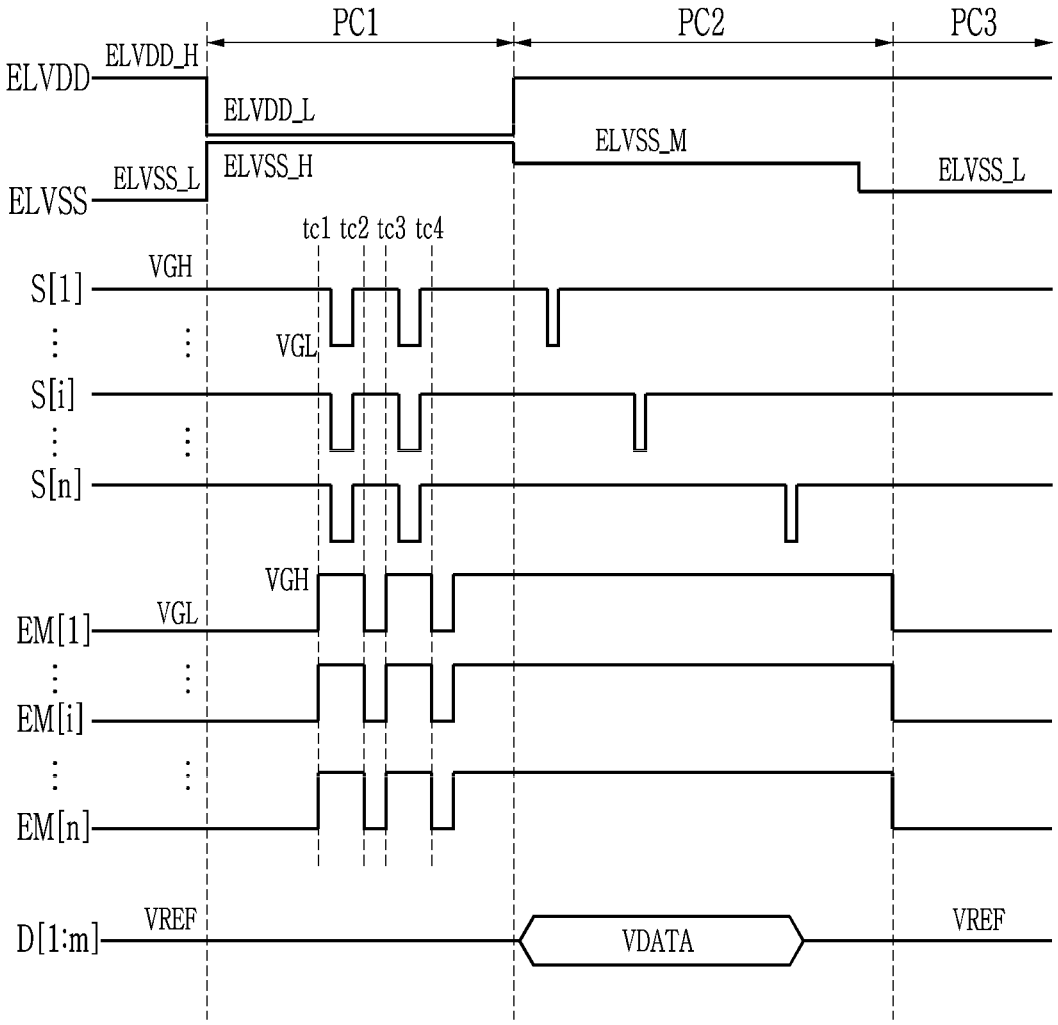
FIG. 10 is a timing diagram of an exemplary driving method of a display device including the pixel of FIG. 9.

FIG. 10 is a timing diagram of an exemplary driving method of the display device having the pixel of FIG. 9.

As shown in FIG. 10, the display device may operate by a simultaneous light emission method that includes non-light emission periods PC1 and PC2 during which pixels PX do not emit light and a light emission period PC3 during which the pixels PX simultaneously emit light.

The non-light emission periods PC1 and PC2 each include an initialization period PC1 during which the gate of the first transistor T21 and the anode of the organic light emitting diode OLED are initialized and a data writing period PC2 during which a data signal is written into the pixels PX.

The pixels PX may be connected to first power ELVDD, second power ELVSS, and initialization power VINT, which have voltage levels that fluctuate within one frame period. For example, the first power ELVDD may have one of a first level ELVDD_L, and a second level ELVDD_H which is higher than the first level ELVDD_L. The second power ELVSS may have one of a third level ELVSS_L, a fourth level ELVSS_M which is higher than the third level ELVSS_L, and a fifth level ELVSS_H which is higher than the fourth level ELVSS_M.

During the initialization period PC1, the first power ELVDD has the first level ELVDD_L and the second power ELVSS has the fifth level ELVSS_H.

Before a time tc1 within the initialization period PC1, the light emission control signals EM[1] to EM[n] have the gate-on voltage level VGL. The second node N22 and the anode are connected to the first power ELVDD through the fourth transistor T24, which is turned on by the light emission control signals EM[1] to EM[n], and the first transistor T21, which is turned on by the first power ELVDD. The anode is initialized to a voltage which is acquired by reflecting the threshold voltage of the first transistor T21 to the first level ELVDD. When the first power ELVDD is changed to the first level ELVDD_L at a starting point of the initialization period PC1, a voltage of the second node N22 and a voltage ANODE of the anode of the organic light emitting diode OLED are initialized to a voltage, which is acquired by applying the threshold voltage of the first transistor T21 to the first level ELVDD. That is, the voltage ANODE of the anode of the organic light emitting diode OLED may be initialized.

During a period tc1 to tc2, the scan signals S[1] to S[n] have the gate-on voltage level VGL, and the light emission control signals EM[1] to EM[n] have the gate-off voltage level VGH. The second transistor T22 and the third transistor T23 of each of the pixels PX are turned on by the scan signals S[1] to S[n] having the gate-on voltage level VGL, and thus the first node N21 and the anode are connected. The fourth transistor T21 of each pixel PX is turned off by the light emission control signals EM[1] to EM[n] having the gate-off voltage level VGH.

That is, since after the second node N22 and the anode are initialized to the first level ELVDD_L, the first node N21 and the anode area connected during the period tc1 to tc2, and thus the voltage of the first capacitor Cst, remaining even after a light emission period of a previous frame period, is initialized.

During a period tc2 to tc3, the light emission control signals EM[1] to EM[n] have the gate-on voltage level VGL and the scan signals S[1] to S[n] have the gate-off voltage level VGH. The anode is initialized to a voltage, which is acquired by reflecting the threshold voltage of the first transistor T21 at the first level ELVDD_L by the turned-on fourth transistor T24 and the turned-on first transistor T21.

Next, during a period tc3 to tc4, the scan signals S[1] to S[n] again have the gate-on voltage level VGL and the light emission control signals EM[1] to EM[n] again have the gate-off level VGH.

Accordingly, after the second node N22 and the anode are initialized again by the first power ELVDD of the first level ELVDD_L, the first node N21 and the anode are connected during a period tc3 to tc4, and therefore the voltage of the first capacitor Cst, remaining even after the period tc2 to tc3, is initialized again.

Data voltages according to data signals that have been written during a previous frame period remain in the first nodes N21 of the respective pixels PX even after termination of light emission. According to the illustrated embodiment, for initialization of the first node N21, a first operation that connects the first node N21 and the anode and a second operation that initializes the second node N22 and the anode to the first power ELVDD of the first level ELVDD_L may be iteratively performed. In the timing diagram of FIG. 10, the first operation is performed two times and the second operation is performed three times, but the first node N21 may be initialized only by sequentially performing the first operation, the second operation, and the first operation. Alternatively, the first node N21 may be initialized by iteratively alternately performing the first operation and the second operation during the initialization period PC1.

During the data writing period PC2, the first power ELVDD has the second level ELVDD_H and the second power ELVSS has the fourth level ELVSS_M, and the scan driver 20 may sequentially provide the scan signals S[1] to S[n] having the gate-on voltage level VGL to the scan lines such that the data signal D[j] can be written into the pixels PX.

A data voltage according to the data signal D[m] is transmitted to the first end of the first transistor T21 by the turned-on second transistor T22. In addition, the first transistor T21 is diode-connected by the turned-on third transistor T23. Then, a voltage acquired by applying the threshold voltage of the first transistor T21 to the data voltage is transmitted to the first node N21. Thus, the first capacitor Cst stores and maintains a voltage that corresponds to a difference between voltages at opposite ends of the first capacitor Cst.

During the light emission period PC3, the first power ELVDD has the second level ELVDD_H and the second power ELVSS has the fifth level LEVSS_L. The light emission control signals EM[1] to EM[n] may have the gate-on voltage level VGL.

Then, the fourth transistor T24 is turned on, and a driving current by the voltage stored in the first capacitor Cst is transmitted to the organic light emitting diode OLED and thus the organic light emitting diode OLED emits light.

Although it is illustrated in FIG. 10 that pixels are driven by using the first power ELVDD and the second power ELVSS, which having voltage levels that fluctuate during one frame period, the pixels may be driven by various methods.

In the illustrated embodiment, the second transistor T22 may be a low-temperature polysilicon (LTPS) thin film transistor, and the third transistor T23 may be an oxide thin film transistor. The LTPS thin film transistor has relatively excellent electron mobility and stability, but may have a high possibility of having a significant current leakage. Accordingly, the current leakage flowing through the third transistor T23 may be effectively prevented by implementing the third transistor T23 as the oxide thin film transistor.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a scan driver configured to transmit a plurality of scan signals to a plurality of scan lines;

a data driver configured to transmit a plurality of data signals to a plurality of data lines; and a display portion having a plurality of pixels, each of which is respectively connected to one of the corresponding scan line and one of the corresponding data line, and is configured to display an image through the plurality of pixels that simultaneously emit light according to the corresponding data signals, wherein each of the plurality of pixels comprises:

an organic light emitting diode;

a first transistor having a gate connected to a first node, and being connected between a first power source and an anode of the organic light emitting diode;

a second transistor having a gate connected to a corresponding scan line and being configured to transmit the corresponding data signal to the first node; and a first capacitor connected to the first node, and configured to store a data voltage based on the data signal, and wherein the first power source is configured to apply one of a first voltage level and a second voltage level that is higher than the first voltage level, and to be at the first voltage level entirely for an initialization period in which the gate of the first transistor is initialized based on the first voltage level of the first power source, wherein the scan driver is configured to simultaneously apply scan signals alternating between a gate-off voltage level and a gate-on voltage level lower than the gate-off voltage level to the plurality of scan lines at least two times during the initialization period.

2. The display device of claim 1, further comprising a second capacitor having a first electrode connected to a corresponding data line and a second electrode connected with a first end of the second transistor at a second node.

3. The display device of claim 2, wherein the first capacitor comprises a first electrode connected to an initialization power source and a second electrode connected to the first node.

4. The display device of claim 3, wherein the first power source is configured to apply one of the first voltage level, the second voltage level that is higher than the first voltage level, and a third voltage level that is higher than the second voltage level, and the initialization power source is configured to apply one of a fourth voltage level, and a fifth voltage level that is higher than the fourth voltage level.

5. The display device of claim 4, wherein the first power source applies the first voltage level for a period during which the plurality of data signals are transmitted to the plurality of data lines, and the first power source applies the third voltage level for a period during which the organic light emitting diode emits light.

6. The display device of claim 5, wherein when on-level scan signals are simultaneously applied to the plurality of scan lines for the initialization period, the initialization power source applies the fifth voltage level, and when off-level scan signals are simultaneously applied to the plurality of scan lines, the initialization power source applies the fourth voltage level.

7. The display device of claim 6, further comprising a third transistor having a gate connected to the initialization power source, and being connected between the anode and the second node.

8. The display device of claim 6, wherein the display portion further comprises a common control line that is connected to the plurality of pixels, the scan driver is configured to transmit a common control signal to the common control line, and each of the plurality of pixels comprises a third transistor having a gate connected to the common control line and being connected between the anode and the second node.

9. The display device of claim 8, wherein the scan driver is configured to apply an on-level common control signal of to the common control line during the initialization period.

10. The display device of claim 1, further comprising a light emission control driver configured to transmit a plurality of light emission control signals to a plurality of light emission control lines, wherein each of the plurality of pixels is connected to a corresponding one of the light emission control lines, and the light emission control driver is configured to simultaneously apply on-level light emission control signals to the plurality of light emission control signal lines.

11. The display device of claim 10, further comprising:

a third transistor having a gate connected to the corresponding scan line, a first end connected to the first power source, and a second end connected to the first end of the first transistor at a second node; and a fourth transistor having a gate connected to the corresponding light emission control line, a first end connected to the first power source, and a second end connected to the second node, wherein the second transistor has a first end connected to the first node and a second end connected to the anode, the first capacitor has a first electrode connected to the first power and a second electrode connected to the first node, and wherein the organic light emitting diode further comprises a cathode connected to a second power source.

12. The display device of claim 11, wherein the first power source is configured to apply one of a first voltage level and a second voltage level that is higher than the first voltage level, and the second power source is configured to apply one of a third voltage level, a fourth voltage level that is higher than the third voltage level, and a fifth voltage level that is higher than the fourth voltage level.

13. The display device of claim 12, wherein the first power source is configured to apply the first voltage level and the second power source is configured to apply the second voltage level during the initialization period, and the first power source is configured to apply the second voltage level and the second power source is configured to apply the third voltage level during a period in which the organic light emitting diode emits light.

14. The display device of claim 13, wherein, for the initialization period, when the on-level scan signals are simultaneously applied to the plurality of scan lines, the light emission control driver simultaneously applies off-level light emission control signals to the plurality of light emission control signal lines, and when off-level scan signals are simultaneously applied to the plurality of scan lines, the light emission control driver is configured to simultaneously apply on-level light emission control signals to the plurality of light emission control signal lines.

15. A method of driving a display device having a plurality of pixels and a scan driver to transmit a plurality of scan signals to a plurality of scan lines that are respectively connected to the plurality of pixels, wherein each of the plurality of pixels includes an organic light emitting diode, a first transistor having a gate connected to a first node and being connected between a first power source and an anode of the organic light emitting diode, a second transistor having a gate connected to a corresponding scan line and being configured to transmit a data signal to a first node, and a first capacitor to store a data voltage based on to the data signal, the driving method comprising the steps of:

initializing the gate of the first transistor;

compensating a threshold voltage of the first transistor;

transmitting a data voltage based on the data signal to the first node; and generating a driving signal to cause light to be emitted from the organic light emitting diode, wherein the first power source is configured to apply one of a first voltage level and a second voltage level that is higher than the first voltage level, and to be at the first voltage level entirely for an initialization period in which the gate of the first transistor is initialized based on the first voltage level of the first power source, wherein in the step of initializing the gate of the first transistor, the scan driver simultaneously applies scan signals alternating between a gate-off voltage level and a gate-on voltage level lower than the gate-off voltage level to the plurality of scan lines at least two times during the initialization period.

16. The driving method of claim 15, wherein each of the plurality of pixels further comprises a second capacitor having a first electrode connected to a data line to which the data signal is applied and a second electrode connected to a first end of the second transistor and a second node, the first capacitor having a first electrode connected to an initialization power source and a second electrode connected to the first node, the first power source being configured to apply the first voltage level, the second voltage level that is higher than the first voltage level, and a third voltage level that is higher than the second voltage level, and the initialization power source being configured to apply one of a fourth voltage level, and a fifth voltage level that is higher than the fourth voltage level.

17. The driving method of claim 16, wherein the step of initializing the gate of the first transistor further comprises a step during which the initialization power source applies the fifth voltage level when the on-level scan signals are simultaneously applied to the plurality of scan lines, and the initialization power source applies the fourth voltage level when off-level scan signals are simultaneously applied to the plurality of scan lines.

18. The driving method of claim 17, wherein the step of generating a driving signal to cause light to be emitted from the organic light emitting diode further comprises a step in which the first power source applies the third voltage level.

19. The driving method of the display device of claim 15, wherein the display device further comprises a light emission control driver that transmits a plurality of light emission control signals to a plurality of light emission control lines, each of the plurality of pixels is connected to a corresponding light emission control line, and the light emission control driver simultaneously applies on-level light emission control signals to the plurality of light emission control signal lines.

20. The driving method of claim 19, wherein the step of initializing the gate of the first transistor further comprises the steps of:

when on-level scan signals are simultaneously applied to the plurality of scan lines, the light emission control driver simultaneously applies off-level light emission control signals to the plurality of light emission control signal lines; and when off-level scan signals of the are simultaneously applied to the plurality of scan lines, the light emission control driver simultaneously applies on-level light emission control signals to the plurality of light emission control signal lines.

21. A display device comprising:

a scan driver configured to transmit a plurality of scan signals to a plurality of scan lines and transmit a common control signal to a common control line;

a data driver configured to transmit a plurality of data signals to a plurality of data lines; and a display portion having a plurality of pixels, each of which is respectively connected to one of the corresponding scan line, one of the corresponding data line, and the common control line, and is configured to display an image through the plurality of pixels that simultaneously emit light according to the corresponding data signals, wherein each of the plurality of pixels comprises:

an organic light emitting diode;

a first transistor having a gate connected to a first node, and being connected between a first power source and an anode of the organic light emitting diode;

a second transistor having a gate connected to a corresponding scan line, being connected between the first node and a second node, and being configured to transmit the corresponding data signal to the first node;

a third transistor having a gate connected to the common control line and being connected between the anode and the second node; and a first capacitor connected between the first node and an initialization power source, and configured to store a data voltage based on the data signal, and wherein the scan driver is configured to simultaneously apply on-level scan signals to the plurality of scan lines at least two times during a period in which the gate of the first transistor is initialized.

22. A display device comprising:

a scan driver configured to transmit a plurality of scan signals to a plurality of scan lines;

a data driver configured to transmit a plurality of data signals to a plurality of data lines; and a display portion having a plurality of pixels, each of which is respectively connected to one of the corresponding scan line and one of the corresponding data line, and is configured to display an image through the plurality of pixels that simultaneously emit light according to the corresponding data signals, wherein each of the plurality of pixels comprises:

an organic light emitting diode;

a first transistor having a gate connected to a first node, and being connected between a first power source and an anode of the organic light emitting diode;

a second transistor having a gate connected to a corresponding scan line, being connected between the first node and a second node, and being configured to transmit the corresponding data signal to the first node;

a third transistor having a gate connected to an initialization power source and being connected between the anode and the second node; and a first capacitor connected between the first node and an initialization power source, and configured to store a data voltage based on the data signal, and wherein the scan driver is configured to simultaneously apply on-level scan signals to the plurality of scan lines at least two times during a period in which the gate of the first transistor is initialized.

23. The display device of claim 21, further comprising a second capacitor having a first electrode connected to a corresponding data line and a second electrode connected with a first end of the second transistor at a second node.

24. The display device of claim 22, further comprising a second capacitor having a first electrode connected to a corresponding data line and a second electrode connected with a first end of the second transistor at a second node.

* * * * *